United States Patent [19]

Kawakami

[11] Patent Number: 4,494,293

[45] Date of Patent: Jan. 22, 1985

[54] METHOD AND APPARATUS FOR ATTACHING PIN FITTINGS TO SLIDE FASTENER HAVING SEPARABLE END STOP

[75] Inventor: Koichi Kawakami, Toyama, Japan

[73] Assignee: Yoshida Kogyo K.K., Tokyo, Japan

[21] Appl. No.: 511,565

[22] Filed: Jul. 7, 1983

[30] Foreign Application Priority Data

Jul. 10, 1982 [JP] Japan ..... 57-120180

[51] Int. Cl.[3] ..... B21D 53/50; A41H 37/06

[52] U.S. Cl. ..... 29/408; 29/33.2; 29/766; 29/768

[58] Field of Search ..... 29/33.2, 408, 409, 410, 29/766, 767, 768, 769

[56] References Cited

U.S. PATENT DOCUMENTS 4,122,594 10/1978 Azzara ..... 29/768

4,131,993 1/1979 Azzara ..... 29/768

*Primary Examiner*—Howard N. Goldberg

*Assistant Examiner*—Steven E. Nichols

*Attorney, Agent, or Firm*—Hill, Van Santen, Steadman & Simpson

[57] ABSTRACT

Disclosed herein are method and apparatus for attaching pin fittings to a slide fastener having a separable end stop, in which a pin fitting is attached to a slide fastener by the steps of holding the pin fitting by a pin fitting holder, moving the stringer tape gripped by a gripper for introducing a core portion of the tape into the pin fitting, and deforming the pin fitting to secure it to the core portion. In these method and apparatus, attachment by deforming the pin fitting is performed under a condition where a first fastener element of a fastener element row affixed to the stringer is abutted against an end portion of the pin fitting with a force of a predetermined magnitude.

4 Claims, 9 Drawing Figures

METHOD AND APPARATUS FOR ATTACHING PIN FITTINGS TO SLIDE FASTENER HAVING SEPARABLE END STOP

BACKGROUND OF THE INVENTION

This invention relates to a method and apparatus for attaching a pin and box pin to a core portion of tapes for fabricating a slide fastener having a separable end stop.

In a slide fastener provided with a separable end stop, a pin and a box pin are attached to one ends of the tape core portions of two stringers, the box pin is inserted into a box and is thereafter secured within the box, and a slider is pushed down along one stringer until it abuts against the box. With the slider held in this attitude, the pin is inserted into the box by way of the slider, which is then pulled up to interlock the fastener elements, namely the zipper teeth. Conventionally, in attaching the pin and pin box, a stringer tape is held by a gripper, the gripper is moved along a predetermined path, and a pin fitting which will serve as the pin or box pin is held in the path of travel of the tape core portion, whereby the core portion is inserted into the pin fitting. The pin fitting is affixed to the core portion by plastic deformation. Positioning the core portion relative to the pin fitting, namely inserting the core portion by a certain amount, is performed by sensing the gripper position and stopping the gripper when the latter has reached a predetermined position. However, this method necessitates sophisticated equipment in order to position the gripper accurately. Since the tapes are deformable, moreover, the position of the core portion relative to the pin fitting fluctuates despite accurate control of the gripper position. Furthermore, because of a fluctuation in the position of the pin fitting relative to a pin fitting holder for holding the pin fittings, the positional relationship between a pin fitting and the core portion, namely the positional relationship between the pin fitting and the fastener elements, is not always fixed. Hence there is a possibility of producing separable slide fasteners which are defective.

SUMMARY OF THE INVENTION

It is an object of the present invention to eliminate these problems and provide a method and apparatus for attaching pin fittings, according to which the core portion and the first fastener element directly following the core portion may be constantly positioned relative to a pin fitting at all times.

This invention provides a method of attaching pin fittings to a slide fastener having a separable end stop. This method comprises holding a pin fitting for a pin or box pin by a pin fitting holder, moving a stringer tape gripped by a gripper for introducing a core portion of the tape into the pin fitting, and deforming the pin fitting to secure it to the core portion. In this method, position of the core portion in the pin fitting is determined by making the first fastener element of a fastener element row affixed to the stringer abut against an end portion of the pin fitting under pressure when the core portion is inserted into the pin fitting.

This invention also provides an apparatus for attaching pin fittings to a slide fastener having a separable end stop. The apparatus comprises a gripper for gripping the tape of a stringer and for moving the stringer along a predetermined path, and a pin fitting attaching unit for holding a pin fitting for a pin or box pin, at a position where the pin fitting receives a core portion of the oncoming stringer, and for deforming the pin fitting to attach it to the core portion after the pin fitting receives the core portion. In this apparatus, attachment of the pin fitting by deforming it is performed under a condition where the first fastener element of a fastener element row affixed to the stringer is abutted against an end portion of the pin fitting with a force of a predetermined magnitude.

BRIEF DESCRIPTION OF THE DRAWINGS

Other objects and advantages of this invention will become clear from the following description of embodiments of the invention referring to the drawings, in which.

DETAILED DESCRIPTION OF THE INVENTION

Figure 1:
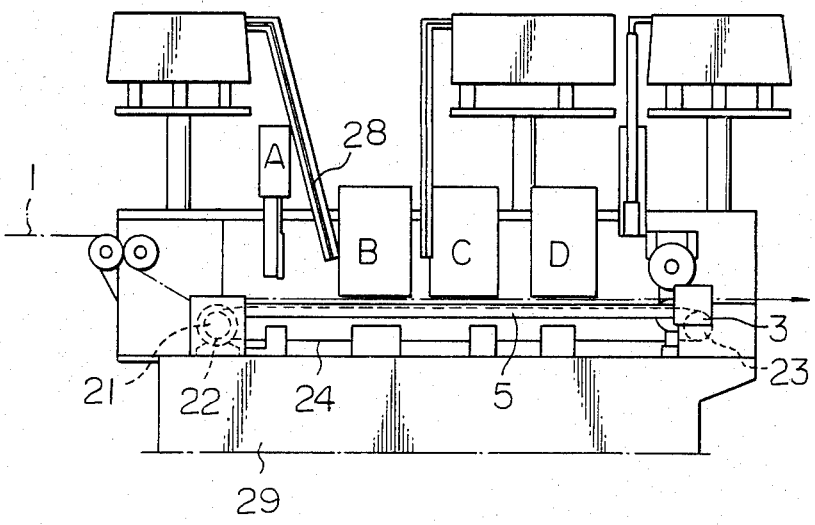
FIG. 1 is a schematic illustration showing the overall equipment for manufacturing a slide fastener having a separable end stop, the equipment making use of an apparatus for attaching pin fittings in accordance with the present invention.

FIG. 1 shows, in simplified form, the overall equipment for manufacturing a slide fastener having a separable end stop, the apparatus making use of an apparatus for attaching pin fittings in accordance with the present invention. A pair of fastener stringers 1, 2, located left and right, are fed from the left side of the drawing (only the fastener stringer 1 being illustrated in the drawing). These stringers are provided intermittently with element-free space portions for partitioning a continuous row of elements into the lengths of the final products. Upper stoppers are mounted at the rear end of the element rows contiguous to the space portion. These continuous stringers 1, 2 are gripped at the tape portions thereof by grippers, described later, whereby the stringers are moved through a cutting unit A, a pin fitting attaching unit B, a slider attaching unit C and a box attaching unit D. In the pin fitting attaching unit B, a pin and box pin are attached to the ends of the stringers in a manner described later. In the slider attaching unit, the two stringers are passed through the interior of a slider simultaneously to be combined into a fastener chain. In the box attaching unit D, a box is attached to the pin and box pin and, in the cutting unit A, a space portion is severed to give a length of the final product. It should be noted that the cutting step may be performed at any time before or after the steps executed by the aforesaid units B, C and D, depending upon the product length. The units A, C and D may consist of known mechanisms capable of performing the desired functions described above.

Figure 2:
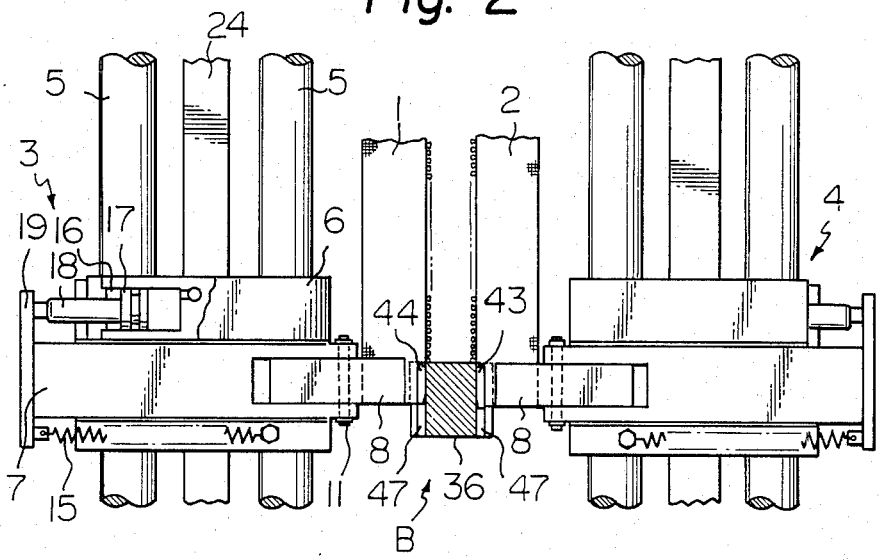
FIG. 2 is a plan view showing grippers in a pin fitting attaching unit.
Figure 3:
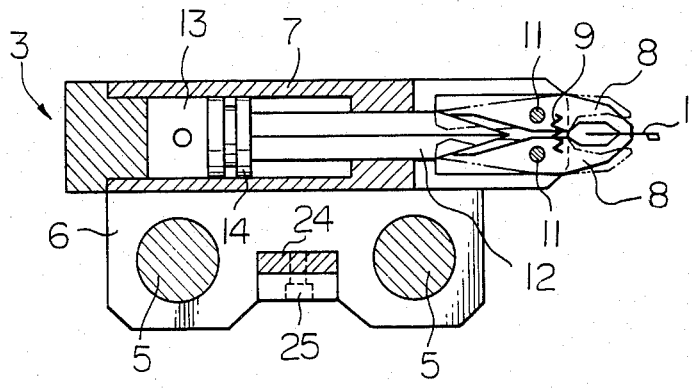
FIG. 3 is a sectional view of one of the grippers shown in FIG. 2.

As shown in FIG. 2, a pair of grippers, left and right, namely a first gripper 3 and a second gripper 4, are provided. Since these grippers are of the same construction, the following description is directed to the gripper 3, but applies also to the gripper 4. The gripper 3 comprises a slide base 6 slidable along guide rails 5 extending lengthwise of the slide fastener manufacturing apparatus, a gripper base 7 mounted for sliding movement transversely of the slide base, and a pair of grip pieces 8, upper and lower, mounted on the gripper base for pivotal movement via pins 11. The grip pieces 8 are biased in the opening direction at all times by a compressiion spring 9, but are pivoted about the pins 11, so as to close, owing to rightward movement of a wedge rod 12 in FIG. 3, the wedge rod engaging with the rear ends of the grip pieces. The wedge rod 12 is connected to a piston 14 slidably accommodated in a fluid cylinder 13 formed within the gripper base 7. The grip pieces can be opened or closed at any desired time by controlling the fluid supplied to the cylinder 13, thereby gripping and releasing the stringer 1.

The gripper base 7 is biased toward the stringer 1 by a tension spring 15, but can be displaced to the left in FIG. 1 at any desired time owing to the fact that the gripper base 7 is connected through a piston rod 18 and a connecting plate 19 to a piston 17 accommodated within a fluid cylinder 16, which is formed in the slide base 6. In this manner, the spacing between the grippers 3 and 4 is adjusted so that, at the initial stage of gripping the stringers I, 2, the first and second grippers grip only the tape portions of these stringers, and so that the stringers will assume a distance best suited for the operations to be carried out in the ensuing steps.

The slide base 6 is mounted by means of a screw 25 to a belt 24 stretched between an idle roller 23 and a roller 22 which rotates with a driving motor 21, whereby the base 6 is slid along the guide rails. The belt 24 is given herein as an example of an endless resilient member and, hence, may be replaced by any similar resilient member.

Figure 4:
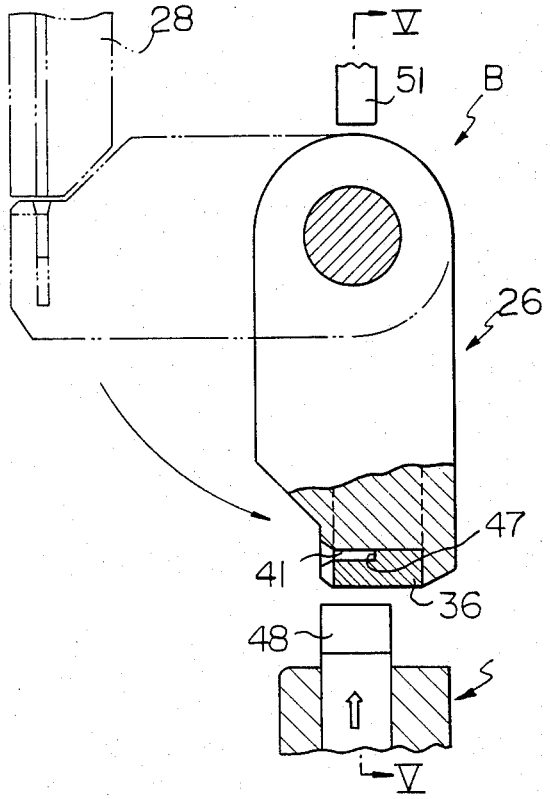
FIG. 4 is a side elevation showing schematically the structure of a pin fitting holder.
Figure 5:
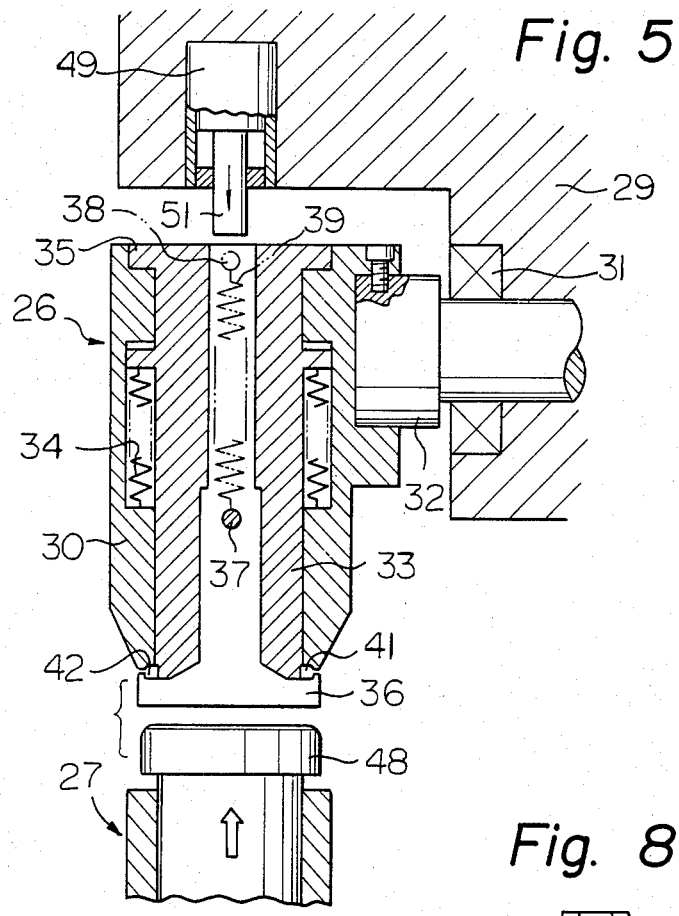
FIG. 5 is a sectional view taken along line V—V of FIG. 4.

The pin fitting attaching unit B comprises a holder 26 for the pin fittings, and a lower die 27. As shown in FIG. 4, the holder 26 may be swung between a position (indicated by the dot-and-dash line) for receiving a pin fitting from a pin fitting supply chute 28, and a position (indicated by the solid line) for holding the pin fitting in the path of travel of the core portions of the stringers 1, 2. FIG. 5 shows the detailed consturction of the pin fitting holder 26. The holder has a casing 30 secured to a shaft 32 rotatably mounted on a base block 29 by a bearing 31 and may be swung at a predetermined timing by a driving device, not shown. A holder case 33 is slidably accommodated within the casing 30. The holder case is biased downwardly by a tension spring 34, with the downward travel of the holder case being impeded by a flange 35 thereof engaging with a portion of the casing 30. A pin fitting holding member 36 is slidably disposed within the holder case 33 and upwardly biased by a tension spring 39 provided between a pin 37 provided on the holding member and a pin 38 secured to the casing 30. The holding member is held in the position shown by engagement thereof with a portion of the holder casing.

Figure 6:
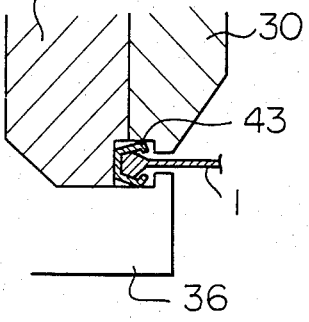
FIG. 6 is a partial view showing the details of a pin fitting holding portion of the pin fitting holder.
Figure 7A:
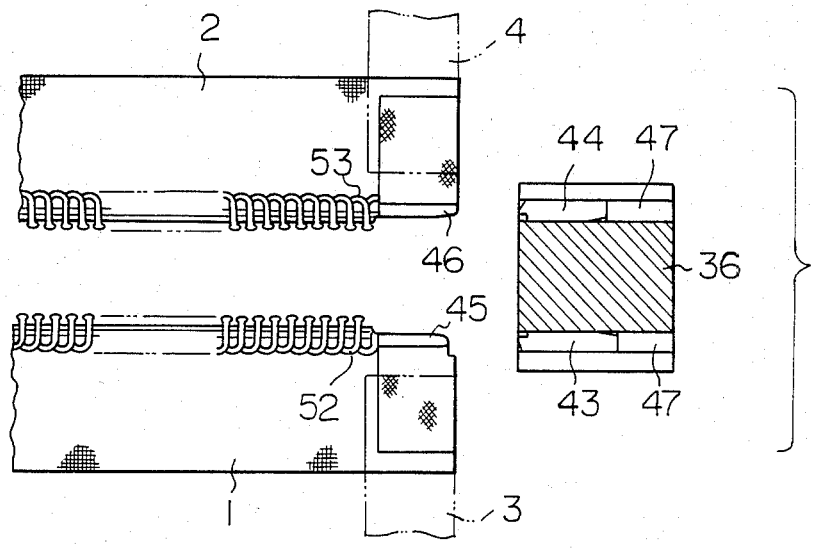
FIGS. 7A and 7B are plan views showing the positions of stringers and the pin fitting holder before and after core portions are introduced into pin fittings.
Figure 7B:
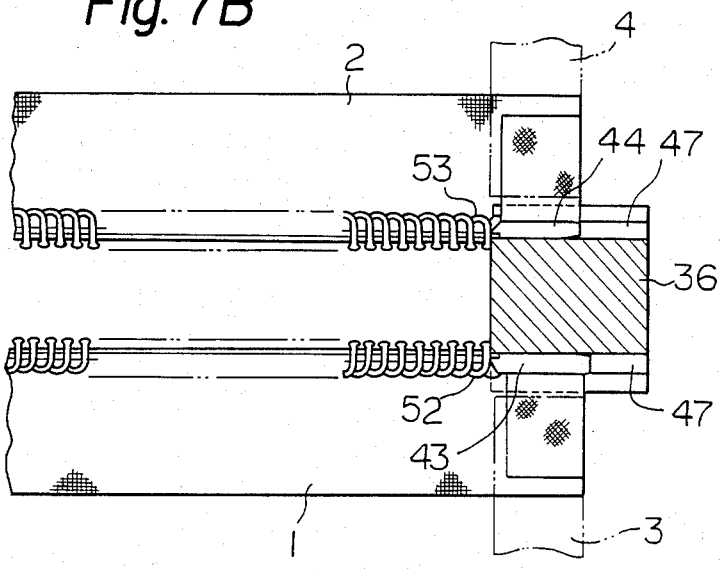

The lower portions of the casing 30, holder casing 33 and pin fitting holding member 36 are configured as shown to form pin fitting holding apertures 41, 42. The arrangement is such that, when the holder 26 is in the attitude shown by the dot-and-dash line, as depicted in FIG. 4, pin fittings intended to a pin 43 and pin box 44 (illustrated in FIG. 7(A)) are introduced from the supply shute 28 into these apertures 41, 42, the holder 26 then being returned to the attitude indicated by the solid lines shown in FIG. 4. When the stringers 1, 2 gripped by the grippers 3, 4 ae moved in this state, the pins fittings will receive the respective core portions 45, 46 thereof (see FIGS. 6, 7A and 7B). The holding member 36 is formed to include a stopper portion 47 which functions to prevent a pin fitting 43 or 44, located in the aperture 41, from moving along with the respective core portion 45 or 46. After the core portions 45, 46 have been positioned with respect to the pin fittings in a manner to be described, a die 48 of the lower die device 27 is raised by a driving device, not shown, for pushing the pin fitting holding member 36 upwards. The pin fitting holding member 36 is thereby raised along with the holder case 33 for pressing and deforming the pin fittings 43, 44 to secure them onto the core portions 45, 46. Thenceforth the die 48 is lowered, followed by actuating a fluid cylinder 49 provided on the base block 29, whereby the cylinder rod 51 presses against the holding member 36 to displace the latter downwardly. In this manner, the pin fitting holding apertures 41, 42 are enlarged to enable the pin fittings 43, 44 to be moved over the stopper 47 with movement of the grippers 3, 4.

In the present invention, how far the core portions 45, 46 of the stringers are inserted into the pin fittings 43, 44 is determined by bringing first fastener elements 52, 53, which directly follow the core portions 45, 46 of the stringers 1, 2, into contact with the ends of the pin fittings 43, 44 with a predetermined force. Thus, in the embodiment illustrated in FIGS. 1 through 7B, the driving motor 21 used should be capable of developing an accurately adjustable maximum torque. When the maximum torque of the motor is set in this manner to a predetermined value, the grippers 3, 4 are prevented from undergoing further movement when they have reached a position at which the resistance offered to the grippers 3, 4 by the first elements 52, 53, which abut against the ends of the pin fittings 43, 44, attains a value corresponding to the maximum motor torque. By attaching the pin fittings in this state, a stringer is obtained in which the relative position between the fastener element row and the pin fitting is always constant, thus resulting in a completed slide fastener which is smoothly interlockable.

Figure 8:
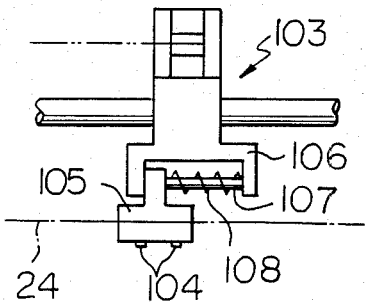
FIG. 8 is a schematic illustration showing another embodiment of the present invention.

FIG. 8 shows a modification of the above-described embodiment. Those portions not described herein are the same as those of the preceding embodiment. In this example, a gripper 103 is not secured directly to the belt 24, and a driving member 105 is mounted to the belt by a screw 104. The driving member and the gripper 103 are connected to each other in a manner to permit relative displacement therebetween in the direction of advance. More particularly, a rod 107 is secured to the slide base 106 of the gripper parallel to the direction of advance thereof, and the driving member 105 is slidably mounted on the rod. A compression spring 108 is provided between the slide base 106 and the driving member 105. The belt 24 moves intermittently in such a manner that the driving member 105 is stopped at a predetermined position. This position is one at which, after movement of the gripper 103 is impeded by the abutting contact between the first element of the stringer and a pin fitting, the driving member 105 undergoes further movement so that the spring 108 will apply a compressive force to the gripper 103, the force acting to the right in the drawing. Although the pressing force which the first element of the stringer applies to the end portion of the pin fitting is variable owing to, say, an error in the positioning of the driving member 105 or fluctuation in the position of the pin fitting in the pin fitting holder, changes in the pressing force caused by minute changes in position are extremely small, so that the stringer core portion can be positioned with the first element being pressed against the pin fitting with a substantially constant force, thus providing a stringer wherein the position of an element row relative to a pin fitting is constant at all times.

What is claimed is:

1. A method of attaching pin fittings to a slide fastener having a separable end stop, comprising holding a pin fitting for a pin or box pin by a pin fitting holder, moving a stringer tape gripped by a gripper for introducing a core portion of the tape into said pin fitting, and deforming said pin fitting to secure it to said core portion, characterized in that a first fastener element of a fastener element row affixed to said stringer is abutted against an end portion of the pin fitting under pressure, whereby said core portion is positioned when inserted into said pin fitting.

2. An apparatus for attaching pin fittings to a slide fastener having a separable end stop, said apparatus comprising a gripper for gripping the tape of a stringer and for moving said stringer along a predetermined path, and a pin fitting attaching unit for holding a pin fitting for a pin or box pin, at a position where said fitting receives a core portion of the oncoming stringer, and for deforming said pin fitting to attach it to said core portion after said pin fitting receives said core portion, characterized in that attachment by said deforming is performed under a condition where a first fastener element of a fastener element row affixed to said stringer is abutted against an end portion of the pin fitting with a force of a predetermined magnitude.

3. An apparatus for attaching pin fittings according to claim 2, wherein said gripper is coupled to an endless resilient member driven by a motor, said motor being halted in rotation when a predetermined torque is attained.

4. An apparatus for attaching pin fittings according to claim 2, further comprising a gripper driving member mounted on said gripper so as to be movable relative to said gripper in the direction of advance of said gripper, a compression spring being provided between the gripper and the gripper driving member, said gripper driving member being halted at a position where said first fastener element is pressed against the end portion of said pin fitting by the action of said compression spring.

* * * * *